United States Patent [19]

Rutherford

[11] Patent Number: 5,075,905

[45] Date of Patent: Dec. 31, 1991

[54] DRAIN TRAP ASSEMBLY

[76] Inventor: Talmadge Rutherford, Rte. 1 Box 1236, Clanton, Ala. 35045

[21] Appl. No.: 642,427

[22] Filed: Jan. 17, 1991

[51] Int. Cl.[5] ..... F16L 55/24

[52] U.S. Cl. ..... 4/191; 4/DIG. 14; 137/247.51

[58] Field of Search ..... 4/191, DIG. 14, 206, 4/194, 197, 198, 195; 285/179; 137/247.51, 247.49, 546

[56] References Cited

U.S. PATENT DOCUMENTS

| | | | |
|---|---|---|---|
| 151,065 | 5/1874 | Tracy | 137/247.51 |
| 404,271 | 5/1889 | Follansbee . | |
| 644,142 | 2/1900 | Mulherin . | |
| 1,684,475 | 9/1928 | Collier et al. | 137/546 |
| 1,817,376 | 8/1931 | Izquierdo . | |
| 2,484,031 | 10/1949 | Havrenius | 4/206 X |
| 3,967,324 | 7/1976 | Olive . | |
| 4,032,455 | 6/1977 | Kale . | |
| 4,164,048 | 8/1979 | Kampfer et al. . | |
| 4,179,762 | 12/1979 | Barnhardt et al. . | |
| 4,546,789 | 10/1985 | Taylor . | |
| 4,700,412 | 10/1987 | Manuel | 137/247.51 X |
| 5,038,816 | 8/1991 | Weltsch | 4/DIG. 14 |

FOREIGN PATENT DOCUMENTS

| | | | |
|---|---|---|---|
| 621143 | 4/1949 | United Kingdom . | |
| 622003 | 4/1949 | United Kingdom . | |
| 2197786 | 6/1988 | United Kingdom | 4/191 |

*Primary Examiner*—Daniel M. Yasich

*Attorney, Agent, or Firm*—Jennings, Carter, Thompson & Veal

[57] ABSTRACT

An improved drain trap assembly which is designed to allow for disposal of sediment with reduced mess and uncleanliness. The improvement comprises a valve which is attached to a drain trap and a compressible container attached subjacent to the valve which collects the sediment. The container when compressed forces residual fluid through the valve such that the valve can be closed to prevent flow of residual fluid back into the container; thereby, the volume of residual fluid in container is reduced prior to removal of container from drain trap. The container is then removed and the sediment is either discharged from the container or the disposable container is discarded. A reduction in discharge of unclean residual fluid into the surrounding area is accomplished by the improvement.

6 Claims, 1 Drawing Sheet

DRAIN TRAP ASSEMBLY

FIELD OF THE INVENTION

The present invention relates to the field of plumbing. More particularly, the invention relates to an improvement in a drain trap which makes cleaning of the drain trap easier. Even more particularly, my invention relates to a removable container associated with a drain trap. In even greater particularity, my invention includes a flexible container which can be compressed to reduce the fluid level therein prior to removal.

BACKGROUND OF THE INVENTION

In the field of plumbing sedimentaceous deposits and subsequent obstruction of a plumbing line as a result of build up of sediment within the drain trap has long been a problem. Removal of a drain trap to clear such an obstruction is a time consuming and messy job, which usually results in water spillage on the plumber and the surrounding flooring. Also, it is difficult to reattach the joint in a leak proof condition.

Numerous attachments have been designed which either make access to the obstruction easier or removal of the sediment easier. For example, U.S. Pat. No. 4,546,789 discloses a valve which allows easy entry of a mechanical cleaning apparatus into the obstructed sewer or drain line. U.S. Pat. No. 644,142 discloses a detachable cup containing germicide or disinfectant. The cup collects and disinfects the sediment simultaneously. The cup is detachable for discharge of the sediment. U.S. Pat. No. 4,179,762 discloses a modified cylindrical base portion to provide for visual inspection and cleaning.

The above disclosed attachments, however, fail to eliminate the problem of spillage of residual fluid on the plumber and the surrounding flooring. In particular, the cup which collects and disinfects the sediment fails to eliminate the release of residual fluid when the cup is removed to be emptied or recharged with disinfectant. The valve which allows for easy access to the obstruction by a mechanical cleaning device fails to prevent the release of the residual fluid when the cleaning device is introduced into the obstructed line. U.S. Pat. No. 4,179,762 provides for visual inspection of the obstruction but fails to provide visual inspection without the drain trap having to be opened and the residual fluid being released either on the plumber or surrounding flooring.

SUMMARY OF THE INVENTION

It is the object of the present invention to provide an improved drain trap assembly which reduces the volume of residual fluid in a obstructed drain trap prior to removal of the obstruction.

Yet another object of the present invention is to provide a drain trap which will allow removal of the obstruction with reduced fluid spillage on the plumber and surrounding flooring or cabinet.

Yet another object of the present invention is to allow for visual inspection of the volume of collected sediment without releasing residual fluid.

Other objects of my invention will become apparent from the detailed description of the preferred embodiment.

BRIEF DESCRIPTION OF THE DRAWINGS

Apparatus embodying features of my invention are depicted in the accompanying drawings which form a portion of this disclosure and wherein.

DESCRIPTION OF THE PREFERRED EMBODIMENTS

Figure 1:
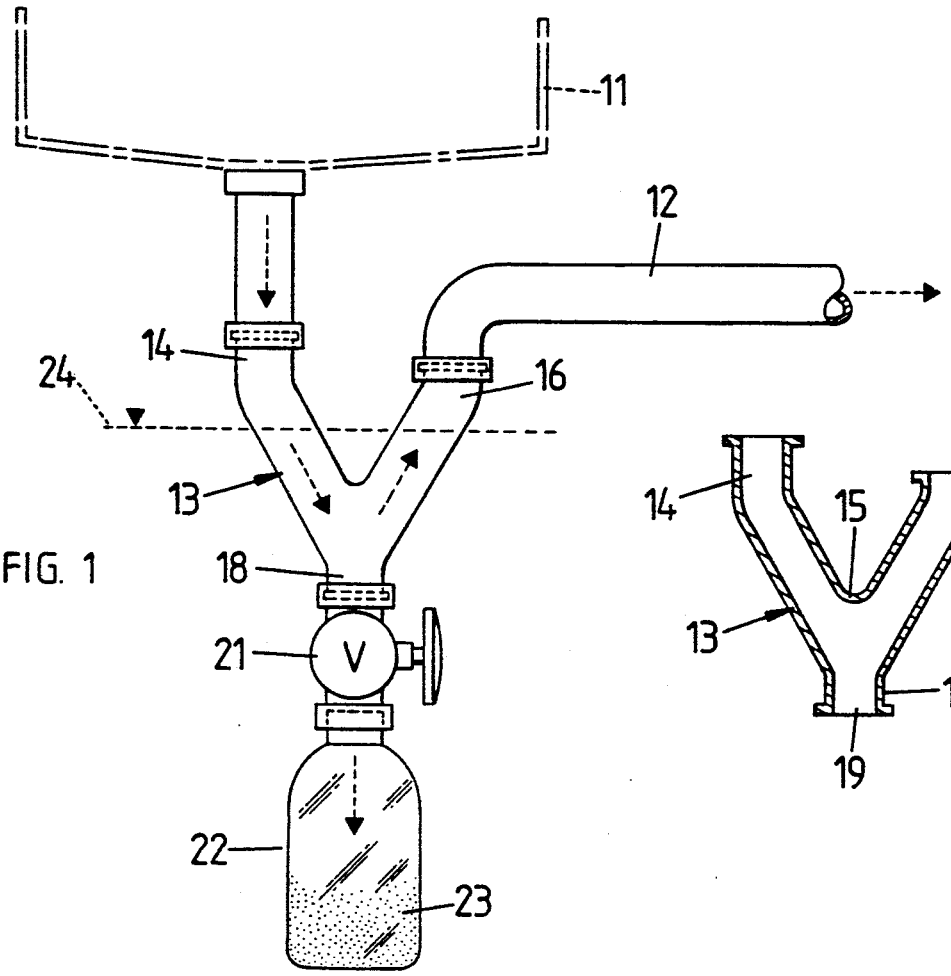
FIG. 1 is a perspective view of the improved drain trap assembly.
Figure 3:
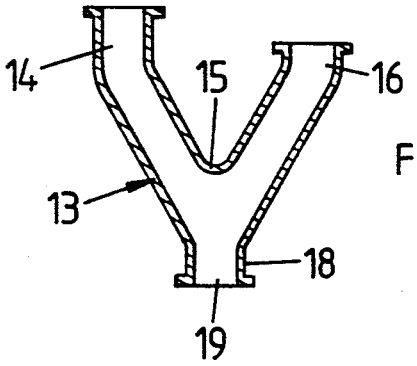
FIG. 3 is cross sectional view of the V-shaped tubular conduit.

Referring to the drawings for a clearer understanding of the invention, FIG. 1 shows a general view of the improved drain trap attached to a sink 11 and a sewer line 12. As is clearly shown in FIG. 3, the improved drain trap is a V-shaped tubular conduit 13 . The conduit has an inlet portion 14 operatively connected to receive fluid from the upstream source, such as a sink drain, forming a junction 15 with an outlet portion 16 operatively connected to discharge fluid into a sewage system. The inlet portion 14 and the outlet portion 16 are of a sufficient downward angle to avoid accumulation of sediment 23 in either the inlet or outlet portions. At the junction is a downwardly extending tubular extension 18. The tubular extension 18 communicates with the conduit at the junction 15 and terminates in an outlet opening 19 as shown in FIG. 3. The tubular extension 18 has a valve 21 connected at its outlet opening 19 to selectively open and close the outlet opening 19. A detachable compressible transparent container 22 for collecting sediment is connected to the outlet opening subjacent the valve 21 in any suitable manner, such as by a threaded connection or by a snap fit connection.

Figure 2:
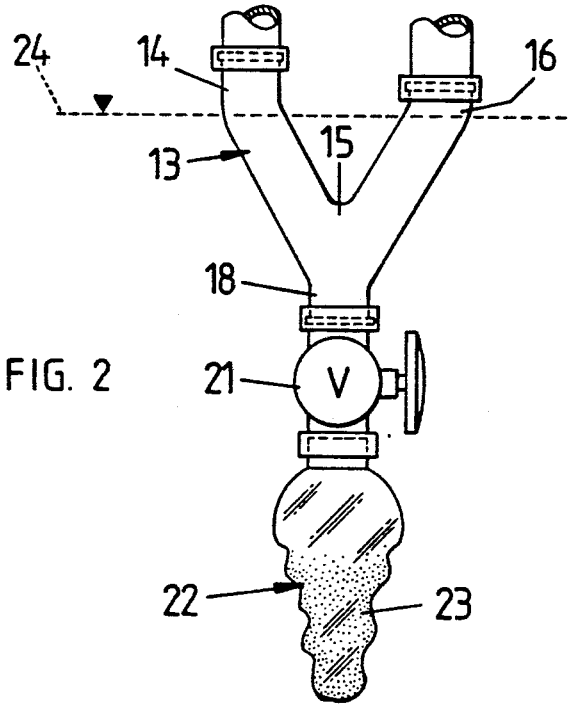
FIG. 2 is a view of the means for collecting compressed.

As shown in FIG. 1, sediment 23 deposits in the container 22 along with fluid 24. When a visual inspection reveals the need for cleaning, the sediment may be removed as follows. The container 22 is manually compressed to reduce the volume as illustrated in FIG. 2. The compression of the container 22 forces the residual fluid 24 upwardly through the valve 21, so that the valve can be closed to prevent flow of the fluid back into the container 22. After the valve 21 is closed, the container can be allowed to assume its normal volume and removed. In as much as the volume of fluid is less than the volume of the container and the valve 21 prevents back flow of residual fluid in the conduits, the sediment 23 can be discarded without spillage of the unclean fluid 24.

Figure 4:
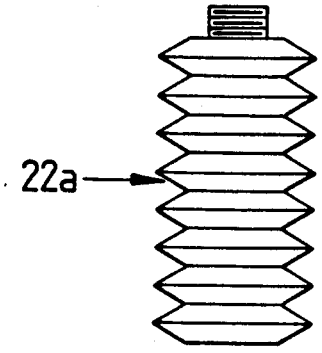
FIG. 4 is a second embodiment of the means for collecting.

The container can be manufactured to be disposable, thus the container would not have to be rinsed or flushed of the sediment. Further, for greater control over the expulsion of the residual fluid, FIG. 4 shows a second embodiment of the collecting container **22*a*** which is an accordion-like container which may be compressed upwardly without exerting lateral unsettling forces on the sediment.

The container can be manufactured to be an expandable bag. Functioning like a balloon being inflated, the bag would expand as sediment collected in the big. The container could be made translucent allowing for visual inspection of the volume of sediment present in the container.

While I have shown my invention in one embodiment it will be obvious to those skilled in the art that is not so limited but is susceptible of various changes and modifications without departing from the spirit thereof.

What I claim is:

1. An improved drain trap assembly for use with plumbing lines, comprising:

(a) a tubular conduit having an inlet portion operatively connected to receive fluids from an upstream source and an outlet portion operatively connected to discharge fluids into a plumbing system;

(b) a downwardly extending tubular extension integrally incorporated at a junction of said inlet portion and said outlet portion and communicating with said tubular conduit at said junction and terminating in an outlet opening below said junction;

(c) a valve connected to said tubular extension and adapted to selectively open and close said outlet opening; and (d) a compressible transparent container detachably connected to said outlet opening.

2. In a drain trap assembly of the type having a V-shaped tubular conduit connected to a sink drain by an inlet portion forming a V-shaped junction with an outlet portion connected to a plumbing line, said conduit having a downwardly extending tubular extension integrally incorporated at said junction of said inlet portion and said outlet portion, said tubular extension having an outlet opening opposite said junction, the improvement comprising;

(a) a valve cooperatively positioned to selectively open and close said outlet opening; and (b) a compressible transparent container detachably connected to said outlet opening such that said container may be compressed to force residual fluid therein through said valve prior to closure thereof for removal of said container and disposal of said sediment.

3. An improved drain trap assembly for use on plumbing lines wherein sediment deposited in said drain trap requires periodic removal thereof, comprising:

(a) a V-shaped tubular conduit having an inlet portion and an outlet portion connected at a junction of said inlet portion and said outlet portion to a downwardly extending tubular extension integrally incorporated at said junction communicating with said conduit and terminating in an outlet opening;

(b) means connected to said outlet opening for collecting sediment deposited in said drain trap comprising a compressible, transparent container having an opening adapted for detachably connecting with said tubular extension such that said container can be disengaged from said tubular extension and emptied of said sediment; and (c) valve means for selectively preventing flow of water between said means for collecting and said conduit.

4. An improved drain trap assembly for use on plumbing lines wherein sediment deposited in said drain trap requires periodic removal thereof, comprising:

(a) a V-shaped tubular conduit having an inlet portion and an outlet portion connected at a junction of said inlet portion and said outlet portion to a downwardly extending tubular extension integrally incorporated at said junction communicating with said conduit and terminating in an outlet opening;

(b) means connected to said outlet opening for collecting sediment deposited in said drain trap comprising a compressible, disposable transparent container having an opening adapted for detachably connecting with said tubular extension such that said container can be disengaged from said tubular means and discarded along with said sediment; and (c) valve means for selectively preventing flow of water between said means for collecting and said conduit.

5. An improved drain trap assembly for use on plumbing lines wherein sediment deposited in said drain trap requires periodic removal thereof, comprising:

(a) a V-shaped tubular conduit having an inlet portion and an outlet portion connected at a junction of said inlet portion and said outlet portion to a downwardly extending tubular extension integrally incorporated at said junction communicating with said conduit and terminating in an outlet opening;

(b) means connected to said outlet opening for collecting sediment deposited in said drain trap comprising a compressible, translucent container having an opening adapted for detachably connecting with said tubular extension such that said container can be disengaged from said tubular extension and emptied of said sediment; and (c) valve means for selectively preventing flow of water between said means for collecting and said conduit.

6. An improved drain trap assembly for use on plumbing lines wherein sediment deposited in said drain trap requires periodic removal thereof, comprising:

(a) a V-shaped tubular conduit having an inlet portion and an outlet portion connected at a junction of said inlet portion and said outlet portion to a downwardly extending tubular extension integrally incorporated at said junction communicating with said conduit and terminating in an outlet opening; and (b) means connected to said outlet opening for collecting sediment deposited in said drain trap comprising a compressible, disposable translucent container having an opening adapted for detachably connecting with said tubular extension such that said container can be disengaged from said tubular means and discarded along with said sediment; and (c) valve means for selectively preventing flow of water between said means for collecting and said conduit.

* * * * *